United States Patent [19]

Jährig

[11] 4,043,517

[45] Aug. 23, 1977

[54] DEVICE FOR CONTROLLING THREAD SPOOLING DRIVES

[75] Inventor: Günter Jährig, Leopoldshafen, Germany

[73] Assignee: Industrie-Werke Karlsruhe Augsburg Aktiengesellschaft, Germany

[21] Appl. No.: 638,172

[22] Filed: Dec. 5, 1975

[30] Foreign Application Priority Data

Dec. 13, 1974 Germany ..... 2458996

[51] Int. Cl.[2] ..... B65H 54/40

[52] U.S. Cl. ..... 242/18 DD; 242/18 R; 242/45; 242/46.4

[58] Field of Search ..... 242/18 DD, 18 R, 45, 242/46.2, 46.4

[56] References Cited

U.S. PATENT DOCUMENTS 3,825,206 7/1974 Schippers et al. ..... 242/18 DD 3,917,182 11/1975 Lenk ..... 242/18 DD X

*Primary Examiner*—Stanley N. Gilreath

*Attorney, Agent, or Firm*—McGlew and Tuttle

[57] ABSTRACT

A device for controlling thread spooling drives in which a bobbin package and its associated carrier roller are frictionally driven by a motor driven drive roller comprises a rotatable carrier roller shaft having a conical portion formed thereon bevelled radially outwardly and arranged substantially in alignment with an end conical formation on a bobbin carrier roller. The rotatable motion is transmitted from the rotatable carrier roller shaft to the bobbin carrier roller by engagement of a clutch cone having a double cone portion between the conical end portion of the bobbin carrier roller and the conical portion of the carrier roller shaft. The engagement and disengagement is effected by a fluid control device and the whole carrier shaft drive is supported in a housing for movement toward and away from the drive roller.

5 Claims, 2 Drawing Figures

DEVICE FOR CONTROLLING THREAD SPOOLING DRIVES

BACKGROUND OF THE INVENTION

1. Field of the Invention

This invention relates in general to the construction of the drive mechanism for spool winding frames and in particular to a new and useful device for controlling thread spooling drives in which a bobbin package is driven by frictional engagement with a drive roller and wherein the bobbin carrier is rotatably supported on a carrier roller shaft connectable through a double cone clutch acting on conical portion of the bobbin carrier and a conical portion of the carrier roller shaft to interconnect the two for controlled rotation thereof.

2. Description of the Prior Art

Synthetic filaments are generally wound up by frictional roller drives. That is, the bobbin or the bobbin package is driven by applying the drive roller which is rotated at a constant speed against the package. As the bobbin is brought into contact with the drive roller, the bobbin is accelerated to the required circumferential velocity through the tube contacting surfaces and under the effect of appropriately adjusted contacting pressure. Upon attaining the circumferential velocity, the spooling power is transmitted from the drive roller to the surface of the bobbin package. By such an arrangement the bobbin as well as the package is disadvantageously stressed, not the least because of the unavoidable slip of the bobbin or the package relative to the drive roller.

In order to avoid this drawback it is known to provide a device for controlling such thread spooling drive to the effect of obtaining constant wind up velocity. In such a device a speed control D.C. motor is used for driving the bobbin. In addition for controlling the speed of the motor changing with the increasing package, a control roller permanently applying against the package surface is provided. An external rotor of a D.C. synchronous motor serves as the control roller. The rotor receives its circumferential speed corresponding to the desired spooling velocity from a D.C. synchronous generator supplying the motor. Because of the rotary mounting of the stator shaft, a relative rotary motion is produced between the shaft and the control roller. Upon occurrence of a transmission torque between the surfaces of the bobbin and the control roller, the relative rotary motion serves simultaneously as the control variable for the motor. Although the arrangement in accordance with this construction has proved very satisfactory in many respects, the proportion of the mechanical and electrical expensed to the obtained controlling effect of the device is relatively unfavorable.

Another device for controlling the starting velocity of a bobbin carrier which is equipped with a turbine drive includes an arrangement in which the rotatably mounted bobbin carrier shaft carries a turbine wheel with appropriately oriented guide vanes as well as the bobbin tube. The bobbin tube or the thread package which is formed on the tube is in permanent contact with a pilot roller rotating at a constant speed. At the start of the device the turbine wheel is exposed to the compressed air stream $L_1$, for example of 8 bars which is subsequently reduced at the end of the starting phase to a compressed air stream for example of 4 bars for a supporting blow. Even though this solution involves for example the advantage of a turbine which is relatively elastic from the point of view of the control technique, the realization of such a design requires very considerble expensed if the necessary precision of the manufacture of the turbine wheel or the cost of the air compression are considered.

SUMMARY OF THE INVENTION

The present invention is an improvement over the prior art and provides a relatively simple, inexpensive design insuring an unchanged high efficiency. In accordance with the invention the device includes a shaft which is connected to the drive motor of the bobbin carrier and supported at several points along its axial length and carries a clutch cone which is associated with a matching conical formation at the end of the bobbin carrier roller. Driving engagement between the carrier roller and the associated carrier roller shaft is effected by a clutch having a double cone which engages simultaneously between the conical end portion of the bobbin carrier roller and the carrier roller shaft conical portion. The actuating forces for engaging and disengaging the clutch are preferably fluid drive motors which may be of the pneumatic or hydraulic type.

The motor driving the carrier roller shaft is advantageously coupled to the shaft through a stepped pulley belt transmission or a stepped gear transmission.

Accordingly it is an object of the invention to provide an improved device for controlling thread spooling drives in which a bobbin package and its associated carrier roller are frictionally driven by a motor driven roller, which comprises a rotatable carrier roller shaft having a conical portion aligned with a conical edge portion of a bobbin carrier roller which is freely rotatable on the shaft and which are interconnected for rotation together by a clutch member having a double cone engagement portion which is disposed between and engageable with the carrier end portion and the conical portion of the shaft to transmit rotation of the shaft to the bobbin carrier roller.

A further object of the invention is to provide a device for controlling thread spooling drives which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

GENERAL DESCRIPTION OF THE PREFERRED EMBODIMENT

Figure 1:
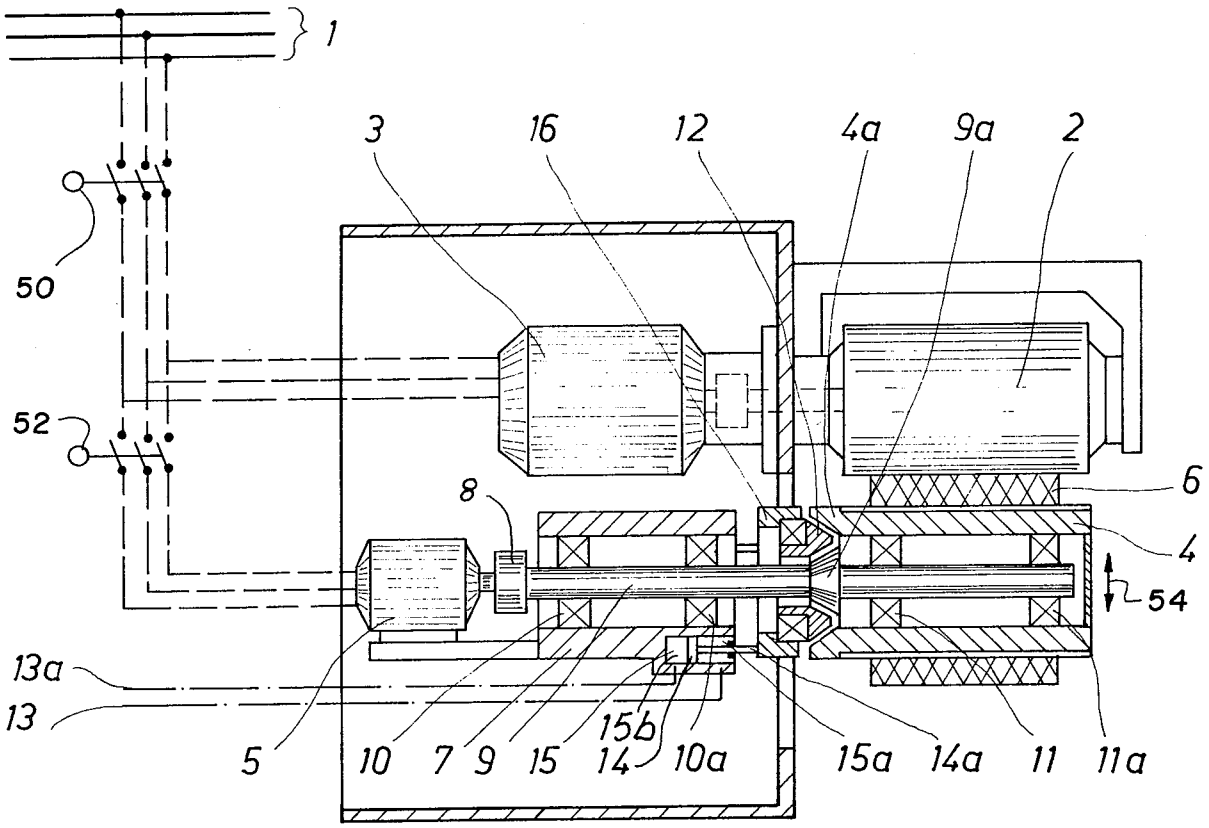
FIG. 1 is a diagrammatical partial elevational and partial sectional view of a device for controlling thread spooling drives constructed in accordance with the invention.

Referring to the drawings in particular the invention embodied therein comprises a motor 3 which is arranged to drive a drive roller 2 for winding thread onto a reel of a bobbin package 6. The motor 3 is connected to a power supply 1 through a power supply line having a switch 50 for the motor 3 and another switch 52 for connecting a drive motor 5 for a carrier roller shaft 9. In order to insure that a permanent contact is established between te drive roller 2 and the bobbin package 6 which constantly increases during the winding operation, the bobbin carrier 4 and its drive motor 5 as well as the connecting part 7 are mounted for vertical displacement which is effected by rotation of a shaft 17 as shown in FIG. 2 to displace the assembly in the directions of the double arrow indicated at 54 in FIG. 1.

The motor 5 is connected by means of a coupling 8 to a carrier roller shaft 9. The carrier roller shaft 9 is mounted for rotation on spaced sets of bearings 10 and 10*a* in the connecting part 7 and on a similar set of spaced roller bearings 11 and 11*a* which are arranged inside of a bobbin carrier 4. Roller bearings 11 and 11a also support the bobbin carrier 4 for free rotation about the shaft 9.

In accordance with a feature of the invention a conical portion or cone 9*a* is formed on the shaft 9 in alignment with a conical edge portion or oblique surface 4*a* formed on the edge of the bobbin carrier 4. A rotatable drive is effected between the rotatable carrier roller shaft 9 and the bobbin carrier 4 by means of a clutch member including a double cone 12 which is located between and engages with the respective conical portion 9*a* and conical end portion 4*a.* The axial shifting of the clutch member 12 is effected by a fluid drive which includes a cylinder 15 arranged at the interior of a wall portion of the connecting part 7. The coupling and the uncoupling action may be produced pneumatically or hydraulically for example by directing a fluid selectively into either line 13*a* or 13 and cylinder space 15*b* or 15*a* in order to shift a piston 14 to either to the right and to move piston rod portion 14a and a bearing disc 16 containing the double cone clutch 12 in the direction of clutch engagement with the oblique surface 4a and the conical surface 9*a* or to the left to effect disengagement of the clutch. When the pressurized fluid is supplied to the line 13*a* into the rear portion of the cylinder 15 behind the piston 14, the piston 14 moves to the right hand side with the piston rod 14*a* to thereby move the bearing disc 16 and the double cone 12 in the same axial direction so that the coupling connection is established and a reverse direction of movement effects the disengagement of the coupling connection. For disengagement the pressurized fluid is supplied to the portion of the cylinder 15 in front of the piston 14 while at the same time the fluid from the rear portion is discharged. The axial displacement of the bearing disc 16 may thereby lead to the disengagement of the double cone 12 both in the cone 9a and the oblique surface 4a of the bobbin carrier 4 at the same time.

Figure 2:
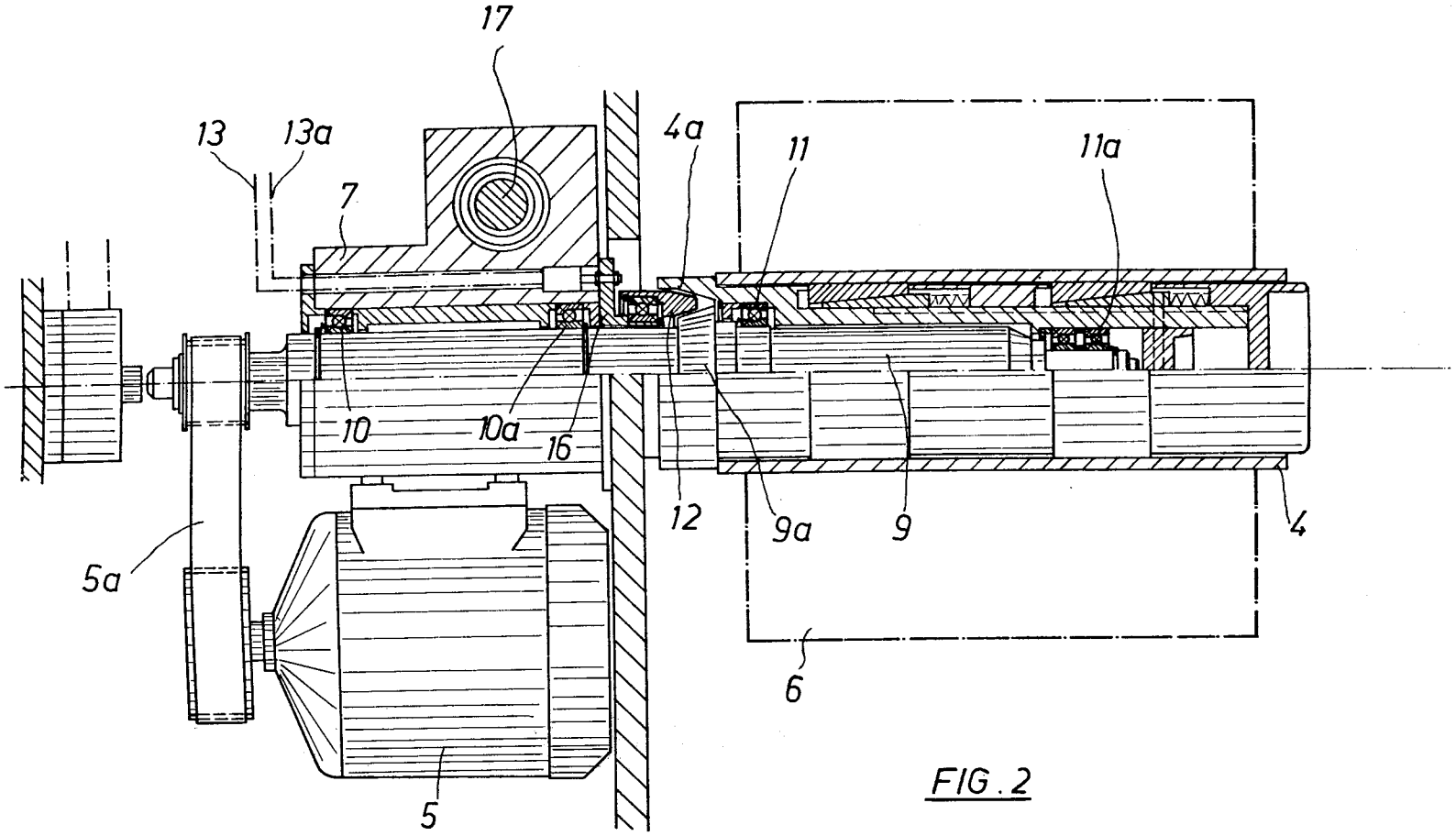
FIG. 2 is a horizontal sectional view of the mounting and drive of the carrier roller shaft shown in FIG. 1.

As shown in FIG. 2 the shaft 9 is advantageously driven by a motor 5 which drives through a stepped pulley belt transmission 5*a* or a stepped gear transmission (not shown).

The inventive device is not only relatively simple and inexpensive in construction and operation, but also, primarily due to the use of the double engagement of the drive shaft and the end of the bobbin carrier by the double cone 12, there is a considerable reduction in the friction occurring between the drive roller and the yarn package during the winding operation. In addition the double cone construction creates a very favorable condition for the transfer of the rotational forces occurring during operation into the shaft. The inventive construction also provides numerous other advantages: during the starting, run up period of the bobbin carrier to the maximum speed, that is to the speed at which with the clutch engaged the circumferential velocity of the empty bobbin corresponds to that of the drive roller, the drive roller comes into frictional contact with the bobbin. In a short period of time thereafter the clutch may be disengaged again and also the motor driving the bobbin carrier may be disconnected. In such a case the speed of the bobbin carrier shaft tends toward zero. It is easily possible however if corresponding conditions are given and after the maximum speed has been obtained, that is as soon as the clutch is engaged, that the circumferential velocity of the empty bobbin coincides with that of the drive roller, to disengage the clutch and to let the bobbin carrier drive motor run along up to the end of the respective winding operation. Variation of the operation described may also provide after reaching the maximum speed and establishing frictional contact between the drive roller and the bobbin as well as the disengagement of the clutch, that the speed of the motor driving the bobbin carrier becomes reduced for example to one half. It is also possible however that the application of the inventive concept to increase the speed only to one half of the maximum velocity and, after the frictional contact between the drive roller and the bobbin has been established and the clutch has been disengaged, to maintain this reduced speed up to the end of the respective winding operation.

A further variant may be obtained if after reaching maximum speed which establishes the frictional contact between the drive roller and the bobbin and the disengaging of the clutch, the control speed of the motor driving the bobbin carrier is reduced. In such a case, the bobbin carrier will rotate at a speed tending toward zero during the winding operation. Disregarding the control speed the above described mode of operation may again be varied by providing for example a hydraulic clutch or other appropriate torque coupling for the further run.

While a specific embodiment of the invention has been shown and described in detail to illustrate the application of the principles of this invention, it will be understood that the invention may be embodied otherwise without departing from such principles.

What is claimed is:

1. A device for controlling thead spooling drives in which the bobbin package and its associated carrier roller are frictionally driven by a motor driven drive roller, comprising a rotatable carrier roller shaft, means for continuously and rotatably driving said carrier roller shaft, a bobbin carrier roller freely rotatable on said carrier roller shaft and having a conical end portion, a conical portion formed on said carrier roller shaft adjacent to said conical end portion and having a conical shaft surface diverging in an opposite direction from said conical end portion, and a clutch cone having a double cone portion disposed between and engageable with said conical end portion and said conical shaft surface, means for shifting said clutch cone axially into engagement with said conical end portion of said bobbin carrier roller and said conical shaft surface of said carrier roller shaft.

2. A device according to claim 1, wherein said shifting means includes fluid pressure operated means connected to said clutch cone for shifting said double cone portion into and out of engagement with said conical shaft surface and said conical end portion of said carrier roller.

3. A device according to claim 1, wherein said fluid pressure operated means comprises a hydraulic device.

4. A device according to claim 1, wherein said means for driving said carrier roller shaft comprises a drive motor, and transmission means connected between said drive motor and said carrier roller shaft.

5. A device according to claim 4, wherein said transmission means comprises a stepped pulley belt drive.

* * * * *